US005399050A

United States Patent [19]

Jacobus

[11] Patent Number: 5,399,050

[45] Date of Patent: Mar. 21, 1995

[54] PLASTIC CONCRETE FORM FOR FOOTERS

[76] Inventor: James L. Jacobus, 2685 Blossom Ave., Columbus, Ohio 43229

[21] Appl. No.: 85,836

[22] Filed: Jul. 6, 1993

[51] Int. Cl.[6] ..... E04B 1/70; E04F 17/00

[52] U.S. Cl. ..... 405/229; 405/43; 52/169.5; 52/274; 249/13; 249/34

[58] Field of Search ..... 52/169.5, 294, 274, 52/293.1, 293.2, 293.3, 720, 721, 730.4, 730.6, 731.7; 405/229 OR, 43, 118, 119; 249/9, 10, 11, 12, 13, 34, 141

[56] References Cited

U.S. PATENT DOCUMENTS

| | | | |
|---|---|---|---|
| 3,017,722 | 1/1962 | Smith | 405/43 |
| 3,170,269 | 2/1965 | Dunnington | 52/293.3 |
| 3,226,935 | 1/1966 | Schneller | 52/294 |
| 3,438,164 | 4/1969 | Duepree | 52/630 |
| 3,613,323 | 11/1971 | Hreha | 52/169.5 |
| 4,333,281 | 6/1982 | Scarfone . | |
| 4,773,195 | 9/1988 | Waller | 52/169.5 |
| 4,798,034 | 1/1989 | Jarnagin et al. . | |
| 4,832,557 | 5/1989 | Jacobsen | 411/485 |
| 4,837,991 | 6/1989 | Shaw . | |
| 4,840,515 | 6/1989 | Freese | 405/45 |
| 4,907,385 | 3/1990 | Biodrowski . | |
| 5,120,162 | 6/1992 | Parker . | |
| 5,224,799 | 7/1993 | Parker . | |

*Primary Examiner*—Carl D. Friedman
*Assistant Examiner*—Wynn E. Wood
*Attorney, Agent, or Firm*—Sidney W. Millard

[57] ABSTRACT

A thermoplastic sidewall forms one surface of a concrete form. The sidewall incorporates a drainage tile as an integral unit. Two of the sidewalls combined can provide a form for a concrete footer to be poured and remain as a permanent part of the structure.

10 Claims, 2 Drawing Sheets

PLASTIC CONCRETE FORM FOR FOOTERS

FIELD OF THE INVENTION

This invention relates to concrete forms and drainage tiles and in particular a sidewall formed of some suitable plastic such as polyethylene combined with a drainage tile which allows the form and drainage tile combination to remain in place around the set concrete.

BACKGROUND OF THE INVENTION

In the construction of dwellings and other buildings it is conventional to excavate the soil around the periphery of the building area for purposes of pouring a concrete footer to serve as a base for the walls of the structure. After the concrete is set, concrete blocks are stacked vertically to form the walls of the structure, including the basement walls if such are desired. Poured concrete walls are sometimes used rather than concrete blocks.

After the excavation it is conventional to use wooden frames which are aligned and leveled in the excavation to serve as concrete forms to receive fluid concrete. Then after the concrete solidifies, the wooden forms are removed and drainage tiles are laid at approximately the level of the footer. Drainage tiles are conventionally laid on both sides of the footer to drain water away from the foundation for purposes which are well known in the construction industry.

The backfill soil surrounding the footer and the drainage tile is usually sand and gravel rather than the excavated soil. This sand and gravel backfill facilitates the easy percolation of water toward the drainage tile where it is drained to a sump pump or to some outlet away from the wall of the structure. Thereby there is no buildup of water pressure on only one side of the basement wall.

Occasionally apertures of some kind are formed in one wall of the concrete blocks near the footer to drain any water which may collect inside the vertically stacked concrete blocks. An example of this is seen in U.S. Pat. Nos. 4,333,281 and 4,907,385. The illustrated drainage holes are toward the inside of the building where one drainage tile is deposed in a sand bed under the concrete basement floor.

U.S. Pat. No. 4,798,034 shows a conventional means for draining water from the basement wall area of a dwelling to a sump pump which performs its usual function.

U.S. Pat. No. 4,837,991 discloses a structure allowing water to drain along the sidewall of the structure through the concrete flooring adjacent the sidewall.

The expense of building and removing wooden forms to accommodate the concrete footer is a problem. However, it is necessary to remove the wooden forms to allow the later installation of drainage tiles after the concrete of the footer has set. Material costs are a relatively minor percentage of the total cost of making the footer and installing the drainage tiles. The largest expense is labor.

SUMMARY OF THE INVENTION

This invention solves a part of this labor expense problem by providing a sidewall for the frame of the footer which is integrally combined with a drainage tile. This allows the form and drainage tile to remain permanently in place. Accordingly, the initial labor of building and leveling the frame for the footer is the only labor cost for the whole operation.

The sidewalls of the concrete form are built to shape the footer and may have sidewalls which are mirror images of each other or one sidewall may be a flat wall while the opposite side is a flat wall formed integral with a drainage tile.

In the most preferred embodiment, the drainage tile is formed integral with the lower half of the form sidewall and a plurality of bracing brackets extend from the upper surface of the drainage tile to the upper edge of the sidewall to reinforce the sidewall against sideward deflection exerted by the pressure of fluid concrete deposited between the sidewalls of the concrete form.

To further reinforce the sidewalls against sideward deflection, reinforcing bars extend across the cavity formed by the two sidewalls of the form and the reinforcing bars engage the upper and lower surfaces of the sidewalls to hold them relatively rigidly in place.

Further, vertically extending ducts are formed on the exterior surface of each sidewall to serve as guides for the location of pegs or half inch reinforcing rods which may be driven into the ground to minimize sideward deflection of the sidewalls and to serve as a mechanism for adjusting the elevation of the sidewalls and drainage tile.

Objects of the invention not understood from the above will be fully appreciated upon a review of the drawings and a reading of the Description of the Preferred Embodiment which follows.

DESCRIPTION OF THE PREFERRED EMBODIMENTS

Figure 1:
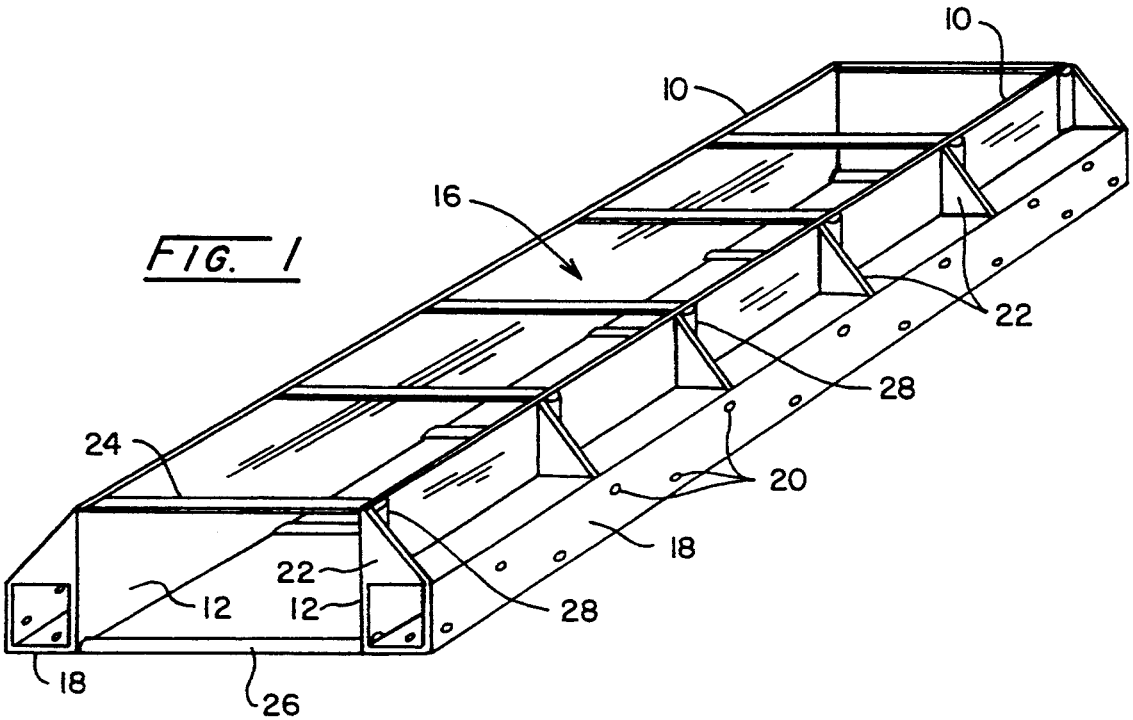
FIG. 1 is a perspective view of the combined concrete form with associated drainage tile.
Figure 2:
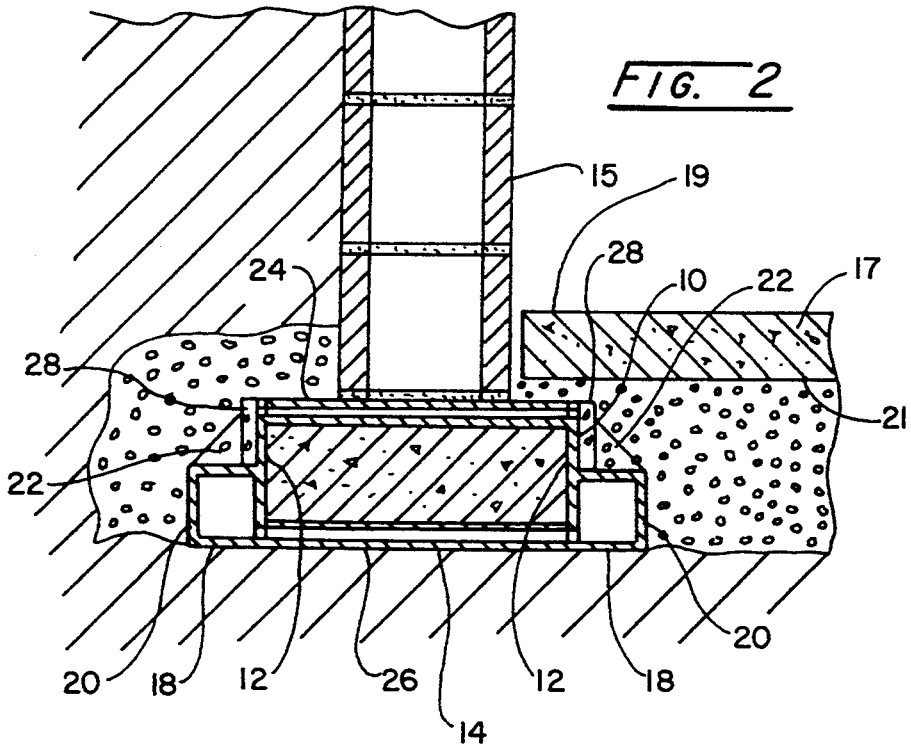
FIG. 2 is a sectional view of a basement wall and floor construction showing the footer and combined concrete forms and drainage tiles illustrated in FIG. 1.

Looking particularly to FIGS. 1 and 2, each side of a concrete form includes a sidewall 10 having one planer surface 12. The two sidewalls together have their planer surfaces 12 facing each other and extending parallel for the purpose of shaping a concrete footer 14 which will be poured into the cavity 16 between the two planer surfaces. Thereafter, a poured concrete or concrete block wall 15 is constructed on footer 14 in conventional fashion.

Each sidewall has a drainage tile 18 formed integral therewith, which is shown as extending parallel to sidewall 10 and including a plurality of openings or apertures 20 spaced randomly along the tile. While the tile is illustrated as being square, it could as easily be rectangular, circular or any other geometric shape.

A plurality of triangular shaped brackets 22 are spaced along the sidewall 10 bridging between the upper surface of drainage tile 18 and the outer surface of sidewall 10. Their purpose is to serve as a reinforcing structure to minimize sideward deflection of sidewall 10 upon the pouring of concrete into the cavity 16.

In a conventional construction project, before the concrete is poured and the footer 14 formed, the substrate supporting the concrete form is generally leveled to a rough, flat surface and the sidewalls 10 are laid out in rough position. Then the sidewalls are aligned and leveled such that the upper elevation of the concrete form is at the proper elevation for the structure it is intended to support. The upper edges of the form sidewalls are intended to be coextensive with the upper surface of the resulting footer. In this invention the spacing between the sidewalls is controlled by upper bar 24 and lower bar 26. The bars 24, 26 and the sidewalls are joined together in a fashion to space the sidewalls the proper distance for the desired width of the footer. The bars serve to minimize sideward deflection caused by the pressure of the fluid concrete flowing into the cavity 16 during the formation of the footer.

After the sidewalls 10 are properly aligned, before concrete is poured, the sidewalls are vertically adjusted to the proper elevation and held in place by a wooden or plastic peg 38 or a reinforcing bar driven into the substrate below the concrete form through a duct 28 formed integral with the exterior surface of sidewall 10. As shown in FIG. 1 the reinforcing rod will pass downward through duct 28, through drainage tile 18 and into the subsoil. Then the sidewall 10 may be raised or lowered as needed, based on a carpenter's level which may sit on the upper surface of sidewall 10 or a surveyor's level may be used. When the proper elevation is achieved, the form is retained in place by a wire tie, set screw passing through the side of duct 28 to frictionally engage the wooden stake or metal reinforcing bar. Alternatively, if the stake extending downward through duct 28 is a plastic or wooden stake, a nail may be driven through the duct or sidewall 10 into the stake to maintain the sidewall at the proper elevation.

Figure 3:
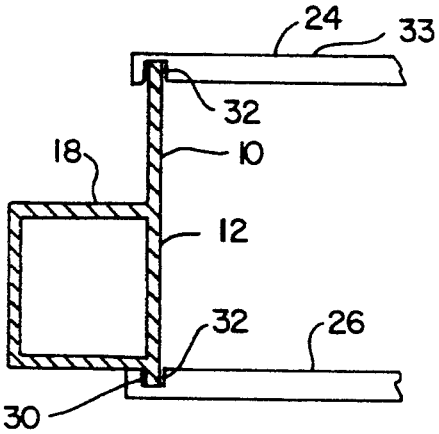
FIG. 3 is a sectional view of an alternative embodiment of the combined sidewall and drainage tile structure of FIG. 1.

Reinforcing bars 24 and 26 may be solid or more preferably hollow because they extend from one side of the footer to the other, and where they are hollow an excess of water on one side of the wall may drain to the other side through the hollow reinforcing bar. The structure of FIG. 3 shows the sidewall 10 having the drainage tile 18 moved upward a slight amount to accommodate a downwardly projecting section 30 at the lower end of wall 10 to fit into a slot 32 which extends about half way through a circular tube 26 serving as the lower reinforcing bar. The same is true of upper reinforcing bar 24 but bar 24 is inverted to have slots 32 facing downward. Additional transverse slots 33 may be cut into bar 24 to drain water from inside the concrete block wall 15.

Figure 4:
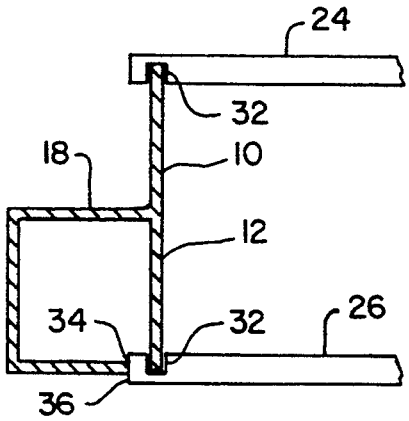
FIG. 4 is a sectional view of another alternative embodiment similar to FIG. 3.

Alternatively, an opening 34 may be punched in the lower surface of drainage tile 18 to accommodate the outer end 36 of reinforcing bar 26 and the FIG. 4 embodiment allows the drainage tile 18 to be formed without the downwardly projecting section 30.

Figure 5:
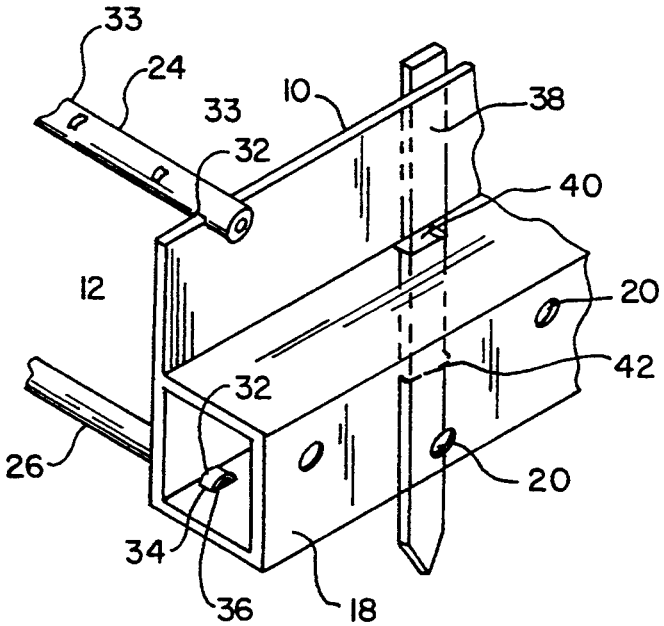
FIG. 5 is a perspective view of the structure of FIG. 4.

FIG. 5 shows in perspective view the alternative structure of FIG. 4 and further illustrates a wooden peg 38 extending through upper and lower apertures 40, 42 in tile 18, immediately adjacent the outside surface of sidewall 10. It is intended that stake 38 penetrate the subsoil and allow a nail to be driven into the wooden stake 38 from the inside sidewall 10 to hold the sidewall at a proper elevation. The stake location will also help to reinforce the sidewall 10 against sideward deflection by the concrete when it is being poured.

Figure 6:
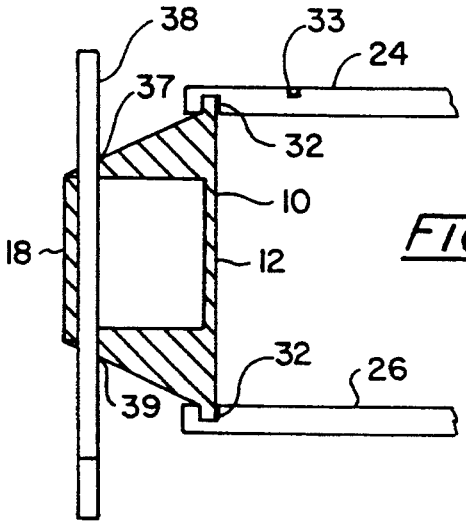
FIG. 6 is a sectional view of another alternative embodiment to the wall-drainage tile combination of FIGS. 3–4.

FIG. 6 illustrates yet another embodiment where the wooden stake 38 passes through apertures 37, 39 which are at the extreme outer edge of duct 18 and in this instance the upper and lower walls of the duct 18 diverge toward sidewall 10 to serve as a reinforcement against sideward deflection. This eliminates the need for brackets 22 illustrated in FIG. 1.

FIGS. 3, 4 and 6 illustrate that the sidewall 10 and drainage tile 18 combination may be extruded as a single unit of thermoplastic resin such as polyethylene and cut to length as desired or apertures 20 through the wall of the drainage tile 18 may be made in any conventional manner after the extrusion has taken place. Note in FIGS. 1, 4 and 5 that some apertures 20, 34 and 42 are formed in the bottom of tile 18.

Figure 7:
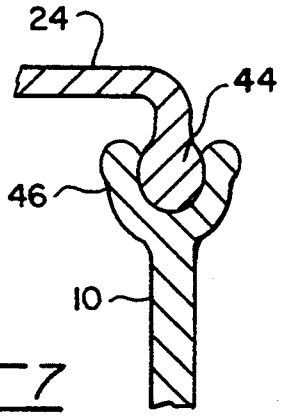
FIG. 7 is a fragmentary sectional view of an alternative structure for connecting reinforcing bars to the sidewalls of the concrete form.

FIG. 7 shows an alternative connecting structure between the top of sidewall 10 and upper reinforcing bar 24 where the reinforcing bar includes a downwardly projecting bulb 44 which may snap into a properly configured female receptor 46.

Figure 8:
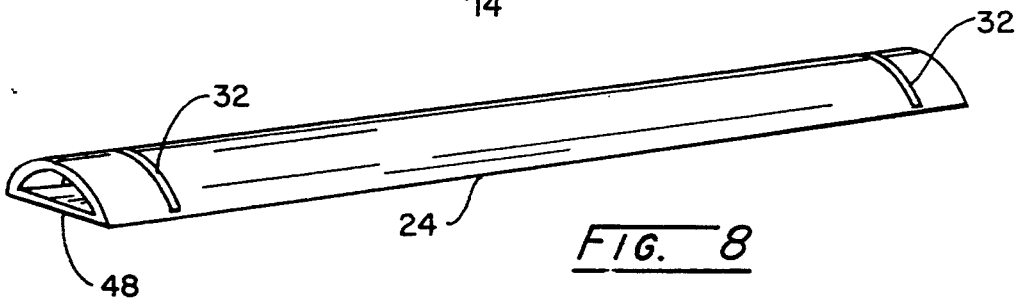
FIG. 8 is a perspective view of an alternative shape for the reinforcing bars to be used with the sidewall structure illustrated in FIG. 1.

FIG. 8 illustrates an alternative shape for reinforcing bars 24 and 26 which comprises a semicircular shape where the flat side 48 faces outwardly of the cavity 16 and this shape may be used where there is a need for the reinforcing bars 24, 26 not to project above the upper or lower surfaces of the footer 14. By way of example, a footer may have a width of about 16 inches and a depth of about 8 inches which will be uniform along the sidewalls of the footer although the depth is not required to be held within close tolerances so long as the upper surface remains at the desired elevation.

It is within the inventive concept to provide slits in the flat surface of the reinforcing bar of FIG. 8 to provide drainage holes such as holes 33 in FIG. 5. Further, such slits or holes may be covered by tape during the concrete pouring. After the concrete sets the tape may be stripped away to expose the drainage openings.

Having thus described the invention in its preferred embodiment, it will be clear that modifications may be made without departing from the spirit of the invention. Also the language used to describe the inventive concept and the drawings accompanying the application to illustrate the same are not intended to be limiting on the invention. Rather it is intended that the invention be limited only by the scope of the appended claims.

I claim:

1. The combination of a concrete floor, a concrete support wall mounted on the upper surface of a concrete footer, a pair of sidewalls to define the shape of said footer and a hollow drainage tile, comprising, said floor having an upper surface and a lower surface, said concrete footer having side surfaces, upper and lower surfaces, a length, a width and a depth, said lower footer surface being supported on a substrate, said pair of sidewalls each having a planer surface in contact with a footer side surface, said sidewalls being located below the lower surface of said floor, said hollow drainage tile being formed by extrusion as a single unit with at least one of said sidewalls, said drainage tile extending parallel with and at the same elevation as said footer side surfaces, apertures extending through the surface of said drainage tile to allow water to enter said tile and be drained from the environment adjacent said footer.

2. The combination of claim 1 wherein said drainage tile extends along and at the same elevation as said one footer side surface, a plurality of reinforcing brackets engaging both said one wall and said drainage tile surface to maintain the structural integrity of said footer during the time fluid concrete is being poured and until said concrete sets.

3. The combination of claim 2 including a plurality of hollow ducts extending vertically along each sidewall to receive a stake which may be driven into said substrate to assist in maintaining said sidewalls in proper vertical and horizontal location.

4. The combination of claim 3 including a plurality of strengthening bars bridging across said footer and attached to said sidewalls to prevent sidewall deflection during concrete pouring.

5. The combination of claim 4 wherein at least some of said bars are hollow to allow liquid drainage from between said sidewalls.

6. The combination of claim 5 wherein said bars are embedded in said footer near both its upper and lower surfaces.

7. The combination of claim 1 including a plurality of strengthening bars bridging across said footer and attached to said sidewalls to prevent sidewall deflection during concrete pouring.

8. The combination of claim 7 wherein at least some of said bars are hollow to allow liquid drainage from between said sidewalls.

9. The combination of claim 8 wherein said bars are embedded in said footer near both its upper and lower surfaces.

10. The combination of claim 1 wherein at least some of the aperture means are located at the lowest level of said drainage tile.

* * * * *